United States Patent [19]

Schweitzer

[11] Patent Number: 4,798,078

[45] Date of Patent: Jan. 17, 1989

[54] REBAR CUTTING AND BENDING MACHINE

[76] Inventor: Leonard J. Schweitzer, 3272 Susileen Dr., Reno, Nev. 89509

[21] Appl. No.: 59,703

[22] Filed: Jun. 8, 1987

[51] Int. Cl.[4] ..... B21D 9/10; B21D 43/28

[52] U.S. Cl. ..... 72/389; 83/200; 72/212; 72/479; 72/324; 72/326

[58] Field of Search ..... 72/324, 212, 213, 384, 72/389, 457, 458, 479, 326; 83/602, 694, 673, 674, 199, 200

[56] References Cited

U.S. PATENT DOCUMENTS

| | | | |
|---|---|---|---|
| 663,998 | 12/1900 | McCabe | 83/200 |
| 1,265,345 | 5/1918 | Rock | 83/200 |
| 2,144,321 | 1/1939 | Bauberger et al. | 72/389 |
| 3,333,445 | 8/1967 | Mergler et al. | 72/389 |
| 3,389,629 | 6/1968 | Tamburr | 83/200 |
| 3,568,493 | 2/1971 | Wirt et al. | 72/389 |
| 4,005,593 | 2/1977 | Goldberg | 72/389 |
| 4,304,117 | 12/1981 | Rawson | 72/389 |
| 4,594,875 | 6/1986 | Schweitzer | 72/389 |

FOREIGN PATENT DOCUMENTS

| | | | |
|---|---|---|---|
| 1955114 | 6/1970 | Fed. Rep. of Germany | 72/390 |
| 18772 | 6/1970 | Japan | 72/389 |
| 0003782 | 1/1977 | Japan | 83/200 |

*Primary Examiner*—David Jones

*Attorney, Agent, or Firm*—Townsend & Townsend

[57] ABSTRACT

A hand-operated rebar bender, bent rebar straightener, and rebar cutting machine which includes a base, a pair of spaced apart bending posts, and a linearly reciprocable slide disposed between the posts and movable reciprocally in directions perpendicular to a line interconnecting the posts. The slide defines first and second grooves, both adapted to receive the rebar, which move with the slide. The grooves are positioned so that the straight rebar to be bent and the inclined legs of bent rebars to be straightened can be positioned tangent to the post. The base includes a guideway for the slide and, in one of its first and second positions, an end of the slide projects past the guideway. A rebar cutter defined by a frame releasably connected to the base includes a pair of rebar cutting discs having aligned, peripherally open grooves, one of the discs being fixed and the other being rotatable relative to the one. The rotatable disc includes a radially projecting arm arranged so that it is aligned with and proximate to the guideway for the slide when the peripheral disc grooves are in mutual alignment. When the slide end moves out of the guideway, it engages the actuating arm, pivot it relative to the fixed disc and thereby cuts a rebar disposed in the peripherally open, aligned grooves of the discs.

32 Claims, 5 Drawing Sheets

REBAR CUTTING AND BENDING MACHINE

BACKGROUND OF THE INVENTION

1. Field of the Invention

This invention relates to a hand operated device for cutting and bending metal bars, such as bars used to reinforce concrete, generally known as rebars, and in particular to such a device which is portable and can be used on the ground at construction sites.

2. Description of Prior Art

U.S. Pat. No. 4,594,875 issued June 17, 1986 to the inventor hereof, discloses and claims an improved rebar bending machine which is lightweight, hand operated and adapted to be used in the field by a single person. It has a laterally stabilized, elongated base and, mount to the base, a pair of spaced apart forming posts which straddle a slide mounted pair of lugs that form between them a groove into which rebar to be bent is placed. The slide is movable in an elongated guideway in a direction perpendicular to a line interconnecting the centers of the forming posts so that the groove defined by the lugs can be moved from a first position, at which a rebar placed in the groove is substantially tangent to the peripheries of the posts, past the line interconnecting the post centers, to a second position on the other side of the posts. In the course of this linear movement of the grooves a bend is formed in that portion of the rebar disposed between the lugs. Depending upon the length of travel of the lugs a bend of less than, equal to or greater than 90° is formed in the rebar although 90° bends are by far the most common.

That patent further discloses to generate the relatively large bending forces with an elongated handle that is pivotally attached to the base on the side of the posts which is opposite the side in which the rebar holding groove is substantially tangent to the post peripheries. Suitable linkage connected to the handle and the slide translates the pivotal handle movements into linear slide motions.

To minimize the weight of the bending machine, and to maximize the bending force, the slide post and linkage are arranged so that the slide does not travel substantially more than the distance it must travel to effect the greatest bend in the bar, typically a bend of not more than about 120°. In this manner, the overall length of the device in general and of the slide base and guideway in particular can be minimized, which saves weight, labor and costs. Within a given size and configuration of the machine, the bending force that can be generated with the manually operated handle can be maximized. An effective, high speed and accurate bending of the rebar is thus possible with the device of that patent.

Bending machines constructed in accordance with the above-mentioned patent have been on sale for more than a year and have met with exceptional success. It is believed that the success is to a large extent attributable to its compact size relatively low weight and to its easy operation even on the uneven ground frequently encountered at construction sites.

At construction sites, it is frequently necessary to cut a bent or straight rebar. Although many rebar cutters are known and available, they are usually heavy, stationary. and/or machine-operated devices which, not infrequently are relatively remote from the place where a rebar is being bent with bending machine of the type disclosed in the '875 patent. Thus, the bar to be cut must be hand-carried to the cutting machine, wherever it may be located, cut, and then returned to the location where it will be used. This is time-consuming, for large diameter and/or long rebars constitutes heavy physical labor, and is, therefore, costly.

Further, it is sometimes necessary to straighten previously bent rebar. This may be to undo a previously erroneously formed bend, to a need to reform a previously bent bar for use in a different application, or the like. Since the straightening of previously bent bar requires the same force as is required to form the original bend, a machine is necessary to accomplish it. The bending machine disclosed in the above discussed patent is not well suited to perform this task (unless the bend is only slight and substantially less than 90°) because a 90° bent rebar, for example, in the groove between the lugs cannot be simultaneously engaged with the forming posts so that the slide can be operated to straighten the bent section. To accomplish this the travel length of the slide-recounted lugs must be substantially increased. This, however, significantly increases the length of the device, and therewith its weight and cost, which is undesirable.

SUMMARY OF THE INVENTION

The present invention significantly improves the usefulness of the bending machine disclosed in the above-discussed '875 patent by making it possible to cut, as well as bend, a rebar with the same basic bending machine and at the location where the machine is being used, thereby eliminating the need to hand-carry the rebar to a separate cutting machine, for example. Further, another aspect of the present invention makes it possible to both bend an originally straight bar and straighten a previously bent rebar. This latter aspect is achieved with no or only a negligible increase in the overall length of the machine and, thereby, also its weight.

Generally speaking, the present invention provides a rebar cutting machine defined by a pair of closely adjacent cutting discs, one stationary and the other pivotal relative to the one, both of which include a peripherally opened groove into which the rebar to be cut can be placed. The discs are mounted in a frame, preferably defined by two spaced apart, rigidly interconnected plates which have an upright portion through which a pivot shaft for the discs extends, and a relatively horizontal portion which is used to connect the cutter with the earlier discussed rebar bending machine.

The rebar bending machine has a base, including a hollow guideway for the slide adjacent one end of the base, generally as described in the above-referenced '875 patent. The guideway for the base is open and the slide is constructed and movable so that one end thereof projects from the open guideway end when the slide is in one of its limiting positions of travel. The guideway is at the end of the base which includes the lateral stabilizer and the horizontal portions of the plates of the cutter frame include upwardly open slots or cutouts into which the base and/or the lateral stabilizer can be dropped. The slots are formed so as to constrain the base to the horizontal portion of the cutter frame, i.e., to prevent relative movement between the two, both in a direction parallel to the slide movement and (horizontal) direction perpendicular thereto. Moreover, the base and the cutter frame are further preferably constructed so as to prevent relative movements between the two in a third, mutually perpendicular direction, that is vertically, at least while the base and the cutter are connected in their operative positions.

Although for operational purposes the rebar cutter can be permanently secured to the base of the bending machine, for example by welding bolting, or otherwise permanently securing the base to the horizontal portion of the cutter plates, in the presently preferred embodiment the two are easily detachable so that the bending machine can be used without the cutter. This is of advantage because the bending machine is typically used much more frequently than the cutter and, by making the two readily detachable, the bending machine is easier to operate, if for no other reason than because the user thereof need not carry the weight of the cutter at all times. Instead, the cutter is coupled to the bending machine only when rebar cutting is required.

To facilitate the engagement and disengagement of the cutter from the bending machine without having to tediously secure the two to each other, for example with bolts or the like, the horizontal portion of the plates includes the above-mentioned upwardly open slots or cutouts which are positioned, sized, and arranged so as to receive therein the base of the bending machine, including the lateral stabilizer thereof. It is a simple matter, therefore, to lift the end of the bending machine, align it over the horizontal portions of the plates, and drop it into registration with the slots. Since the weight of the bending machine rests on the horizontal portions of the plates the two are effectively constrained and secured to each other.

To enhance the interconnection between the two, another aspect of the present invention provides that the slots in the cutter plates have a depth greater than the thickness of the base. In addition, the plates define a short overhang at the slot end closest to the cutting discs. The overhangs require that the base of the plate be inserted into the slots by moving it into them in an angularly inclined orientation so that the end of the base facing the cutter is lowest and the other end of the base is highest. In this manner, the lowermost end of the base can be slid beneath the overhang and, thereafter, the remainder of the base can be dropped into the slot. Thus, the base and the cutter are further constrained against relative vertical movements also, even though there is no permanent connection between them.

A radially projecting actuating arm is attached to the pivotable disc of the cutter. In one embodiment it is positioned so that a radially outermost end portion of the arm is in substantial alignment with and proximate to the open guideway end in the base of the bending machine when the radially open grooves in the peripheries of the cutting discs are aligned. When the bending machine is operated, by pivoting the handle to linearly move the slide and the guideway, an end of the slide moves out of the open guideway and thereby engages and pivotally moves the actuating arm and the associated cutting disc relative to the fixed disc. This rotationally offsets the previously aligned grooves in the peripheries of the cutting discs, and when a rebar is positioned in the grooves, it is thereby severed. When the slide of the bending machine is retracted, the pivotable cutter disc is returned to its home position, for example by means of a tension spacing connected to the actuating arm of the cutter frame.

In another embodiment of the invention a clamp is pivotally attached to the actuating arm of the pivotal cutter disc. The clamp is movably secured to the arm and has a free. L-shaped end which can be attached to a portion of the slide of the bending machine, such as the lugs which engage the rebar during bending. In this manner the slide of the bending machine positively returns the arm and therewith the pivotable cutter disc to their home position. This embodiment of the invention has the advantage that there is no need to rely on spring forces or the like to effect the return of the disc to its home position. Consequently, the discs can be axially biased towards each other with greater force. This facilitates the cutting operation, prevents the formation of a small gap between the discs which adversely affects cutting, and prevents slag and other foreign particles which may lodge between the disc from interfering with the operation of the cutter.

Another aspect of the present invention provides for an improvement to the bending machine per se so that it is not only possible to bend a straight rebar, but to also straighten a previously bent bar. In this respect, the present invention provides the reciprocating slide with second groove into which bent rebar to be straightened can be placed with, at the most, only a negligible increase in the overall travel length for the slide. The second groove is spaced from the first groove in the direction of slide travel (when bar placed in the first groove is being bent). The second groove is positioned so that bent rebar placed therein is approximately tangent to the peripheries of the forming posts on one side of the posts when straight rebar placed in the first groove is approximately tangent to the peripheries of the forming posts on the other side thereof.

As a result of this positional interrelationship between the first and second grooves the second groove is relatively remote from the forming posts when the slide has been moved the required distance to bend an originally straight bar placed in the first groove. Consequently within these limits of slide travel a much greater distance is attained between the forming posts and the second groove than between the forming posts and the first groove. This significantly larger distance makes it possible to place a 90° bent rebar, for example, into simultaneous engagement with the peripheries of the posts and the second groove by locating the bent portion of the rebar in the second groove. The bent rebar can be straightened by moving the slide in the opposite direction until the second groove is substantially tangent to the periphery of the posts.

The second groove can be constructed in any one of several configurations. It is important, however, to position the second groove as close as possible to the first groove to avoid interference with the pivot support for the handle which activates the slide, or conversely, to avoid the need to increase the spacing between the forming posts and the handle pivot which would again increase the overall length of the device, its weight and cost. In its simplest form the second groove can be defined by spaced apart, first and second lugs in substantially the same manner in which the first and second lugs of the first groove are constructed. In addition, the adjacent lugs for the two grooves can be combined into a single, double acting lug or post.

Bent rebar, when placed in the second groove, can pivot upwardly out of the groove, depending on the length of the bent rebar, the manner in which it is supported by the machine and/or the surrounding ground etc. The present invention also contemplates to constrain the bent rebar in the second groove against such upward movement. To accomplish this another embodiment of the invention defines the second groove partially with one of the lugs for the first groove and a hook, pivotally attached to the lug. The hook can be pivoted over the bent bar in the second groove so that a downwardly oriented free arm of the hook defines a portion of the second groove. Preferably, in this embodiment releasable lock means is provided to secure the hook in either its open or its closed position to prevent an accidental disengagement of the hook from the bar during the bar straightening operation.

DETAILED DESCRIPTION OF THE PREFERRED EMBODIMENT

Figure 1:
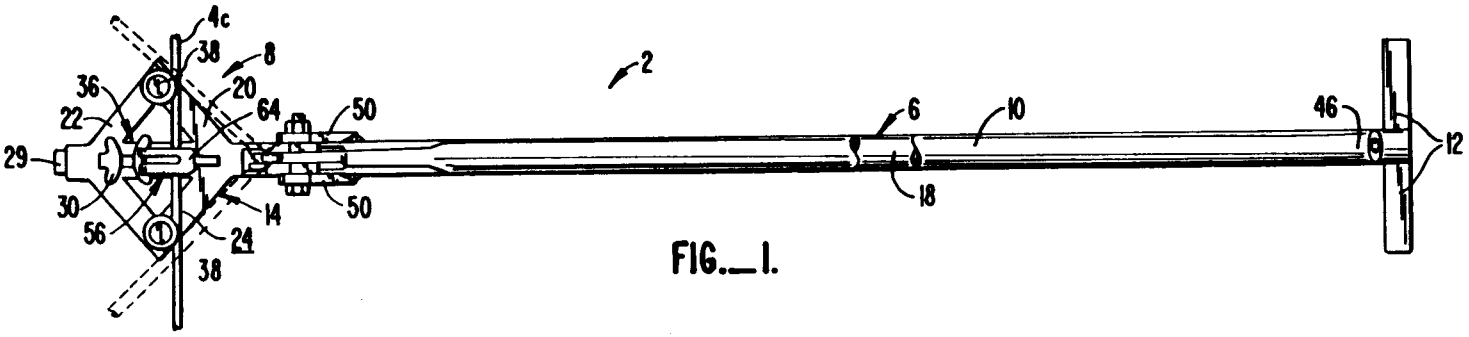
FIG. 1 is a plan view of the improved bending machine of the present invention and illustrates, in phantom lines, a bent rebar to be straightened and, in solid line, the previously bent bar in its straightened configuration.
Figure 4:
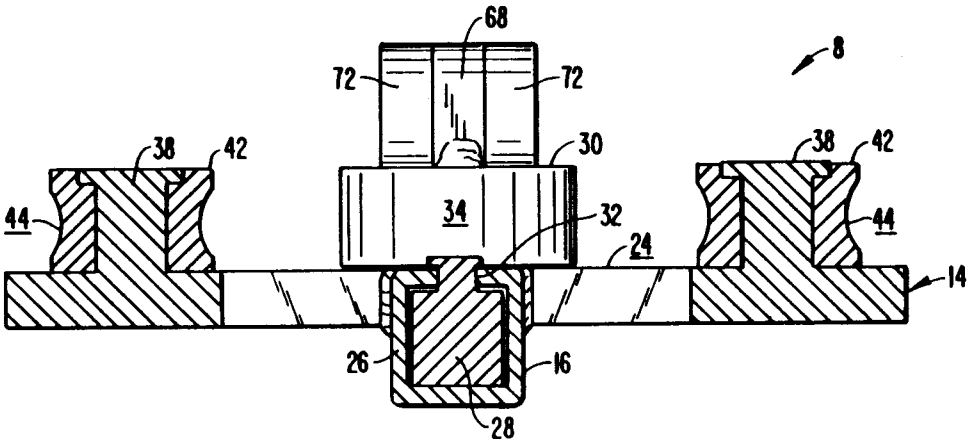
FIG. 4 is a front elevation in cross-section and is taken along line 4—4 of FIG. 2.

Referring to FIGS. 1-4, a portable, hand-operated rebar bending machine 2 constructed in accordance with the present invention for bending straight or for straightening bent metal bar typically round rebar 4, comprises an elongated base 6, a bending mechanism 8 at one end of the base and an actuating handle 10 operatively coupled with the bending mechanism. To provide stability for the machine the base includes generally transversely oriented cross-legs 12 at one end thereof and a transversely extending yoke 14 at the other end of the base and which forms part of the bending mechanism. To reduce the weight of the machine while maintaining rigidity the base and the cross-legs are preferably constructed from steel pipe.

Yoke 14 forms one end of the base and supports and houses the bending mechanism 8. It includes a tubular center section 16, which is secured e.g., welded to or integrally constructed with the proximate end of an elongated steel pipe 18 which forms the major portion of the base, and a pair of angularly inclined arms 20, 22 which laterally protrude from the center section to either side thereof. The free ends of the arms are joined, e.g, welded together. for strength and rigidity. The upwardly facing surfaces of the center section 16 and arms 20, 22 are flat and lie in a common plane to define a flat, horizontal support surface for the rebar to be bent by the machine.

The tubular center section 16 of the yoke defines an internal, elongated, linear guideway 26 which has an open end 27 and which linearly reciprocally mounts an elongated slide 28. One end 29 of the slide projects from the open guideway end 27 when the slide is in one of its limiting positions, as will be further discussed below. The slide includes a pair of spaced apart lugs 30 which protrude from the slide through an elongated, upwardly open slot 32 in the tubular center section 16 of the yoke. The lugs have opposing, convexly arcuate bending surfaces 34 which define between them a first groove 36 of a sufficient width so that straight rebar to be bent can be placed in to the groove. The height of the lugs is greater than the diameter of the largest rebar capable of being bent by the machine, i.e. the height is greater than the width of groove 36.

A pair of bending posts 38 are positioned on a line perpendicular to the guideway 26 at the outward ends of arms 20, 22. Each post comprises a shaft 40 firmly secured. e.g. welded to the yoke and protruding upwardly past the flat support surface 24. A roller 42 is rotatably carried by the protruding portion of the shaft 40 and is suitably restrained to the shaft to prevent relative axial movements of the roller. Each roller has a height greater than the diameter of the largest rebar capable of being bent by the machine and a concave peripheral surface 44 for nesting the rebar during bending.

Handle 10 is preferably an elongated section of steel pipe having a free end 46 which is proximate cross legs 12 and a second end which is pivotal about a pivot shaft 48 carried on supports 50 protruding upwardly from the base. A lever 52 fixed e.g. welded to the second end of the handle is angularly inclined relative to and extends from the handle past the pivot shaft towards guideway 26. A link 54 has its respective ends pivotally attached to the free end of the lever and the proximate end of slide 28. The link translates pivotal movements of handle 10 and the lever 52 into correspondingly reciprocating, linear movements of the slide 28 in guideway 26.

In use the lever is fully raised, or lowered, so that groove 36 between jaws 30 is disposed on one or the other side of a straight line connecting the peripheral surfaces 44 of bending post rollers 42. As shown in FIG. 3. for example, the lever may be initially fully lowered so that the groove is to the left of the bending posts. Next. rebar 4 is placed into the groove (see FIG. 1) and the operator raises handle 10 in a counterclockwise direction, as shown in FIG. 3 until it reaches the inclined position shown in FIG. 3. This pivotal movement of the lever causes a corresponding linear movement of the slide within guideway 26 and, thereby, moves jaws 30 from the left hand side of post 38 to the right hand side thereof (shown in FIG. 2). In the course of this movement, the left hand jaw (as seen in FIGS. 1-3) applies a bending force to the rebar and, upon engagement of the rebar by the concave peripheries of rollers 42, causes the formation of a bend in the rebar as is illustrated in FIG. 1.

The application of the bending force to the rebar causes a centering of the rebar with respect to the concave profile of bending post rollers 42 even if the rebar is originally skewed relative to the posts due to an unevenness of the ground at the construction site, for example. This facilitates the operator's task of maintaining the bend(s) and the bar in planar alignment. Moreover, the convexly shaped bending surface 34 of lugs 30 assure a smooth curvature in the bent rebar and prevent the formation of nicks in its surface which could adversely affect its strength.

Figure 2:
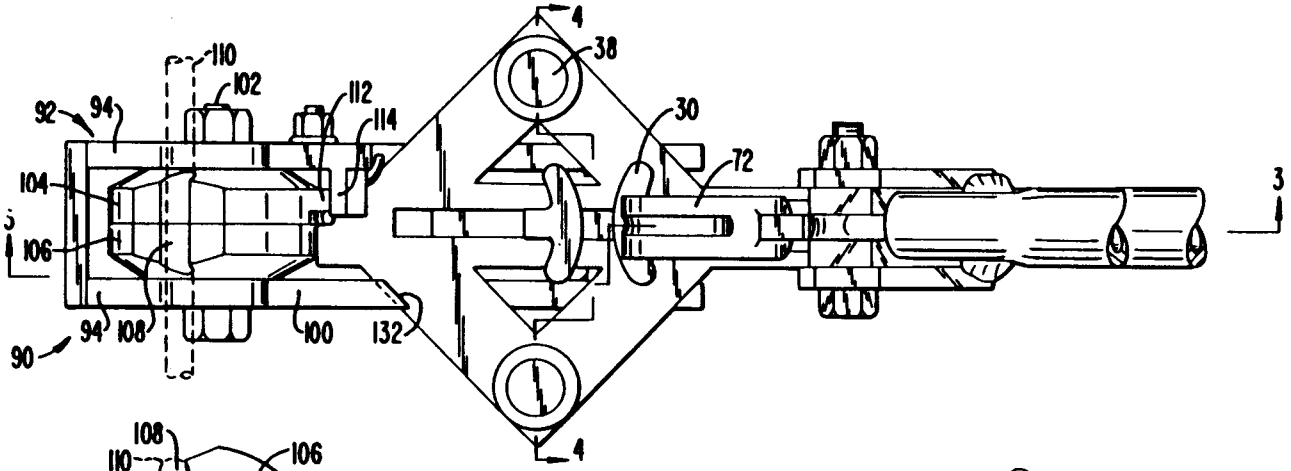
FIG. 2 is an enlarged, fragmentary plan view similar to FIG. 1 and illustrates a rebar cutter constructed in accordance with the present invention attached to the bending machine shown in FIG. 1.
Figure 3:
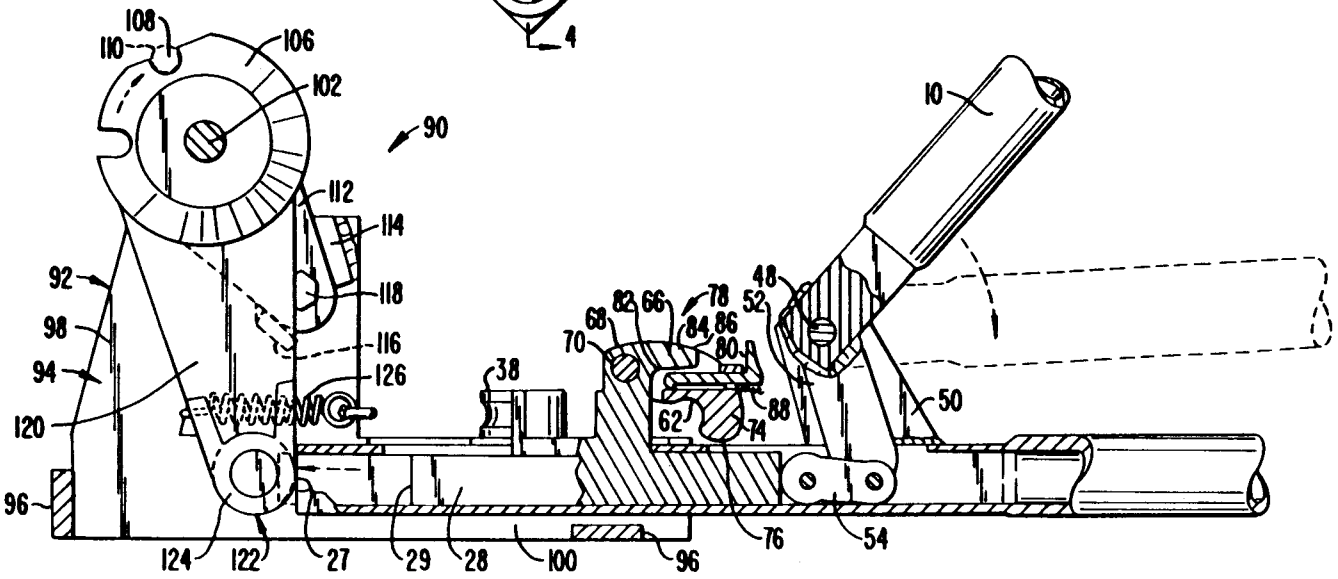
FIG. 3 is a fragmentary, side elevational view, partially in section, is taken on line 3—3 of FIG. 2, and illustrates the rebar cutter and the bending machine of the present invention operatively attached to each other.

Rebar can also be bent by placing it into groove 36 when jaws 30 are to the right of the bending posts as seen in FIG. 2, for example. In such a case the bending operation is performed by moving handle 10 in a clockwise direction as seeing FIG. 3, from its raised position to its lowered position (shown in phantom lines).

The rebar bending device of the present invention is particularly adapted for use in the rough environment typically surrounding construction sites. It is relatively lightweight and is readily carried by one person. Cross-legs 12 and the laterally protruding arms 20, 22 of yoke 14 assure stability of the device even when placed on uneven ground. Tubular center section 16, which defines guideway 26, protects slide 28 from contact with abrasive ground sand, etc. In addition, slide 28 is relatively long, e.g. five to ten times its width, to provide accurate guidance as it reciprocates within guideway 26 without causing wedging even when the forces applied by lugs 30 to the rebar tend to skew the slide.

Referring now to FIGS. 1–5, bent rebar straightening assembly 56 is attached to slide 28 in the manner discussed in greater detail below. In a simplest embodiment of the invention the rebar straightening assembly comprises another pair of spaced apart lugs 58 which have opposing, convex surfaces 60 that define between them a second groove 62 of a sufficient width to accommodate the rebar to be bent. In the simplified embodiment of the invention illustrated in FIG. 5, an upright post 64 defines the respective convex surfaces of one lug each of lug pairs 30 and 58.

Lug pairs 30 and 58, and post 64 if it is used. are secured e.g., welded to slide 28 so that they can be positioned as follows.

Figure 5:
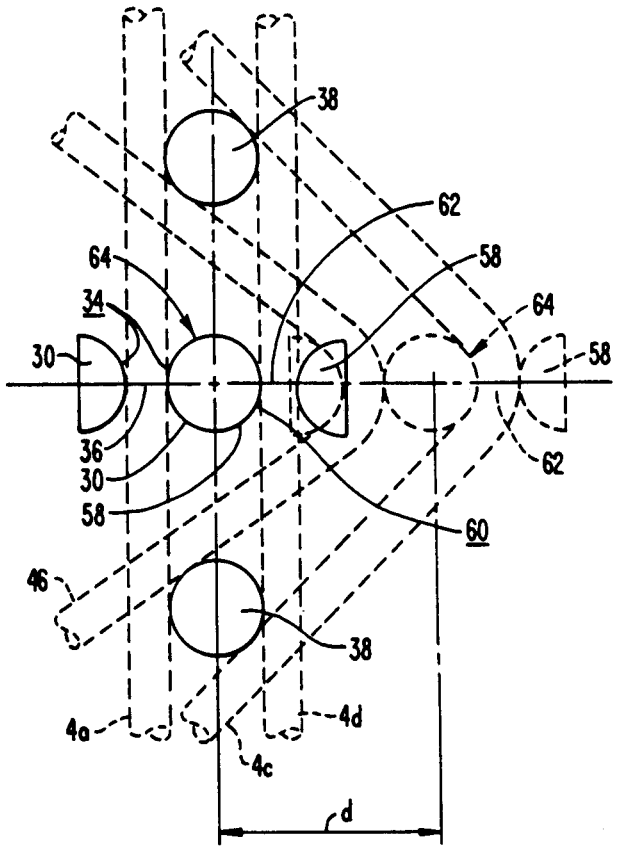
FIG. 5 is a schematic plan view which illustrates the manner in which the present invention is used to bend a straight rebar and straightened a bent rebar.

In a first position of the slide, lugs 30 are located so that rebar 4 placed into the first groove 36 is approximately tangent to the peripheries of bending post 38 as is illustrated in FIG. 5. The term "approximate" as used in connection with the relative positioning of the first groove is meant to indicate that the first groove can be positioned so that a rebar therein is tangent to the bending post peripheries. It further is meant to indicate that the slide can be moved beyond the tangential position, to one where the rebar in the first groove is spaced typically by a small distance, from the bending post peripheries. This both facilitates the insertion of the rebar into the groove and obviates the need for precise tolerances in the relative positioning of a first groove and the forming post which. for a rebar bender used in the rough environment typically prevailing at construction sites, is undesirable and difficult to maintain.

With the slide in the first position, as above defined, the second lug pair 58 (or post 64, if used) is positioned so that a straight rebar, if it were placed in second groove 62, would be approximately tangent to the peripheries of the bending posts but on the side of the bending posts opposite the side on which the first groove is located.

Further, slot 32 in tubular center section 16 has a length, and the handle pivot 48, the handle lever 52 and link 54 interconnecting the lever with slide 28 are arranged and constructed so that the slide can linearly move in guideway 26 from a first position in a first direction (to the right as illustrated in FIG. 5) to a second slide position over a distance "d" selected so that a straight rebar **4*a* placed into the first groove 36 is given the maximum possible bend that can be achieved with the bending machine, e.g. 90°, 120° or whatever other maximum bend may be desired. The second position of lug pairs 30 and 58, as well as of post 64 (which defines one lug of each pair) is illustrated in FIG. 5 in phantom lines. Also illustrated in phantom lines is the shape 4*b*** of the fully bent rebar, in the illustrated example it has a 90° bend.

In the second position of the slide the second groove 62 is spaced relatively far (in the first direction) from bending posts 38. The second lug pair 58 is positioned on the slide so that when the slide is in this second position at least 90° bent rebar **4*c* can be placed into the second groove (with the bent rebar section disposed in the groove) and so that the straight legs of the rebar are tangent to or clear of the peripheries of the bending posts. It is now a simple matter to straighten bent rebar 4*c* by operating handle 10 in the illustrated embodiment by pushing down on the handle to move the slide in a second, opposite direction from its second position to the above discussed first position. During this return movement of the slide bent rebar 4*c* is pushed against the peripheries of bending posts 38 and it is thereby straightened so that, when the slide is again in its first position, the previously bent rebar has taken on a straight configuration as is illustrated in FIG. 5 and identified by reference numeral 4*d***.

Referring now to FIGS. 1–4, in a further embodiment of the present invention rebar straightening assembly 56 is defined by a pivotally mounted hook 66 and a portion of one of lugs 30 as follows. Lug 30 has an upwardly projecting extension 68 which includes a transverse pivot shaft 70 that extends to either side of the extension. Hook 66 has bifurcated arms 72 which straddle the extension and pivotally engage the shaft 70 so that the hook can be pivoted between a first, open position and a second, closed position (shown in FIG. 3.

The hook has a generally L-shaped configuration and includes a free leg 74 which, in the closed second position of the hook, is generally upright and has a free end 76 proximate the tubular center section 16 of the bending machine. When in the closed position the side of lug 30 facing in the first direction, together with free leg 74 of hook 66 define the second groove 62. It should be observed that the portion of the free leg 74 of the hook, as well as of bifurcated arms 72 close the second groove in an upward direction when the hook is in its closed position. Thus, rebar disposed in the second groove is constrained against relative upward movement out of the groove.

To prevent the unintentional opening of hook 66 it includes a lock 78, in the presently preferred embodiment defined by a generally L-shaped flat bolt 80 which can be linearly reciprocated into and out of engagement with an underside 82 of an over hang 84 of extension 68. When flat bolt 80 is moved to the left (as shown in FIG. 3) so that its upwardly directed surface engages underside 82, the hook is locked in its closed position and cannot unintentionally open. Conversely when the bolt is moved to its right, as illustrated in FIG. 3 so that it clears the extension overhang 84, the hook can be pivoted in a counterclockwise direction (as seen in FIG. 3) into its open position. A slanted locking surface 86 on the upper side of overhang 84 is preferably provided to maintain the hook in its open position and to thereby facilitate the insertion of bent rebar to be straightened into the second groove, or the withdrawal of straightened rebar there from. Preferably, a spring 88 (schematically illustrated in FIG. 3) biases bolt 80 into its locking position, that is to the left as viewed in FIG. 3.

In this embodiment of the invention straight rebar is bent in the above-described manner. Bent rebar is straightened by moving slide 28 into its second position that is as far to the right as possible (as seen in FIG. 3), hook 66 is opened the bent section of the rebar is positioned beneath the hook, and the hook is thereafter closed and locked with bolt 80. Handle 10 is now pivoted in a clockwise direction, as viewed in FIG. 3 that is downwardly, to move the slide and with it the second groove and the bent rebar to the left, as seen in FIG. 3, towards bending posts 38. Free leg 74 of hook 66 thereby engages the bent section of the rebar and causes its straightening as it approaches a position at which the side of the rebar facing the bending posts becomes tangent to the peripheries of the bending posts. At that point further movement of the handle is discontinued, it is preferably reverse pivoted a short distance to disengage the straightened rebar from contact with the bending posts, bolt 80 is retracted and hook 66 is pivoted into its open position. The rebar is now withdrawn from the second groove by initially sliding it generally parallel to base 6 and tubular center section 16 until it clears the hook, and by thereafter withdrawing it upwardly.

Referring now to FIGS. 2, 3, 6, and 7, a rebar cutter 90 constructed in accordance with the present invention generally comprises a frame 92, defined by a pair of spaced apart, generally L-shaped plates 94, and interconnecting braces 96. Each plate forms a generally upwardly oriented portion 98 and a generally horizontal portion 100. A pivot shaft 102 extends between the upright plate portions 98 adjacent uppermost ends thereof and mounts first and second cutting discs 104, 106. Each disc includes a radially open cutting groove 108 into which a rebar 110 to be cut can be placed when the grooves are mutually aligned (as illustrated in FIG. 3 for example). The first disc includes a relatively short radial arm 112 projecting from the disc and constrained against rotation by two appropriately shaped and positioned pads 114, 116 secured, i.e., welded to the upright plate portion 98 adjacent disc 104. In addition, a bolt 118 is preferably provided which secures the radial arm to the adjoining plate.

A relatively long arm 120 projects radially from cutting disc 106 in a generally downward direction and has a free end 122 which is proximate open end 27 of guideway 26 in bending machine base 6. The radial actuating arm 120 is positioned so that it is substantially aligned with the guideway and its free end preferably includes a rotatably mounted roller 124 for engagement by free slide end 29 in the manner further described below. A tension spring 126 has ends connected to arm 120 and plate 94 and biases the free arm end 122 in a counterclockwise direction (as viewed in FIG. 3) towards the open guideway end 27. The arm 120 and slots 108 in discs 104, 106 are positioned so that the free arm end contacts the open guideway end when the cutting slots 108 in the discs are in alignment.

The horizontal portions 100 of L-shaped plates 94 have a length (from the upright plate portions 98) which is somewhat longer than the longitudinal extent (in the direction of travel of slide 28) of yoke 14. Each horizontal portion 100 of the plates includes two angularly inclined slots 128, 130, which have a width slightly greater than the width of angular arms 20 22 of the yoke and which have the same angular inclination and relative spacing as the arms so that the yoke can be dropped into the slots. The slots have a depth which is slightly greater than the thickness of arms 20, 22 and the horizontal plate portions further include an overhang 132 at the vertical walls of the slots in the plates which are closest to the vertical plate portions 98. The overhangs project a short distance, say no more than 1/16–⅛" over the slots and their underside is spaced from the bottom of the slots a distance slightly greater than the thickness of yoke arms 20, 22, so that the yoke, and therewith the entire bending machine 2 can be releasably connected to the cutter as follows.

Initially, the cutter is placed on the ground and yoke 14 of the bending machine is lifted and positioned above the horizontal portions 100 of L-shaped plates 94. The end of base 6 opposite from the yoke is now raised, so as to incline the yoke and point the open end 27 of the guideway downwardly. While so inclined, the yoke is lowered into the slots so as to position the arms underneath overhang 32. Thereafter, the opposite end of base 6 (from which cross legs 12 extend) is lowered until the entire yoke is nested in slots 128 and 130. At this point, the yoke is fully supported on the ground by horizontal plate portions 100 and cross legs 12 of the base support at the opposite end thereof. The bending machine and the cutter are now ready for use.

To cut rebar, bending machine handle 10 is initially raised so as to retract end 29 of slide 28 in to guideway 26. This permits spring 126 to bias radial arm 120 in a counterclockwise direction until roller 124 engages the end of guideway 26. Rebar 110 is now placed in the aligned slots 108 and the operator pushes downwardly on handle 10 to rotate it in a clockwise direction (as viewed in FIG. 3). This moves slide 28 to the left, as seen in FIG. 3, and when slide end 29 engages roller 124 of arm 120 causes movement of the arm, and therewith of cutting disc 106 about shaft 102 in a clockwise direction (as seen in FIG. 3). This causes a corresponding rotational offset of the two grooves 108 in cutting discs 104, 106, and thereby severs rebar 110. Once the rebar is severed, the operator lifts handle 110, by rotating it in a counterclockwise direction, as seen in FIG. 3, which retracts slide 28 into the guideway and permits spring 126 to pivot arm 120 in a counterclockwise direction until roller 124 again engages the end of guideway 26. At this point, cutting grooves 108 are again aligned and a fresh bar 110 can be placed therein for making another cut.

Should cutting be no longer necessary, cutter 90 is readily separated from bending machine 2 by lifting the end of base 6 adjacent cross legs 12, that is the end of the base remote from the cutter. As soon as the angular arms 20, 22 clear the slots 128 130 which are relatively remote from the upright plate portions 98, the operator can pull the yoke from beneath overhangs 132 and, once the yoke clears the overhangs, the bending machine is fully disconnected from the cutter, the cutter can be stored for later use, and the bending machine can be replaced on the ground for further rebar bending in the manner described above.

Figure 8:
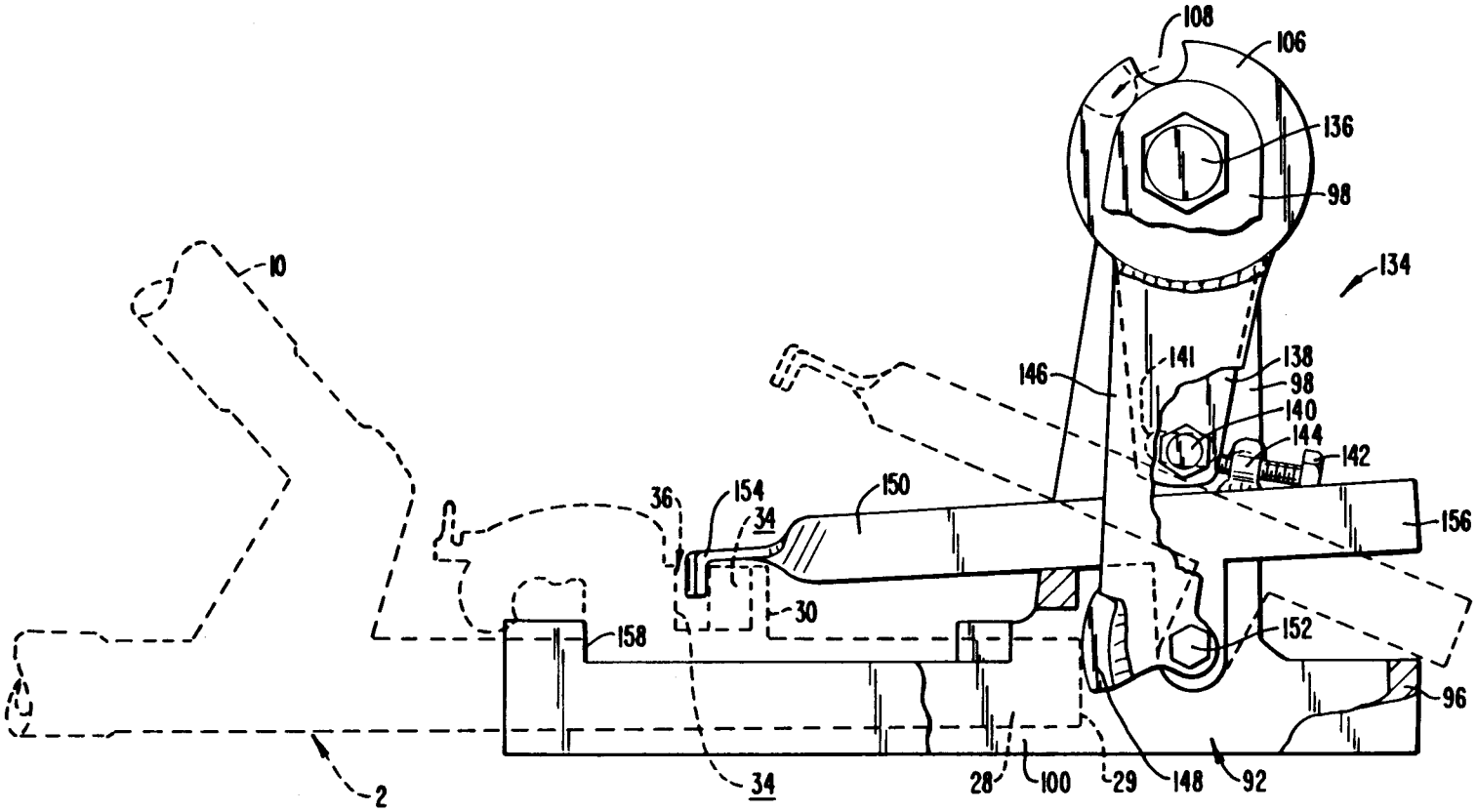
FIG. 8 is a side elevational view, with parts broken and illustrates another embodiment of the rebar cutter of the present invention.

Referring now to FIG. 8, in another embodiment of the present invention a cutter 134 is constructed generally similar to the cutter 90 shown in FIG. 3, for example, and described above. It too comprises a frame 92, defined by pair spaced apart, generally L-shaped plates 94 and interconnecting braces 96. Each plate forms a generally upwardly oriented portion 98 and a generally horizontal portion 100. A pivot shaft, defined by a threaded bolt 136' extends between the upright plate portions adjacent uppermost ends thereof and mounts the first and second cutting discs 104. 106 each of which further includes the radially open cutting groove 108 into which a rebar (not shown in FIG. 8) to be cut can be placed when the grooves are axially aligned. The first disc includes a relatively short radial arm 148 the free end of which is anchored to the adjoining upright plate portion 98 with a bolt 140.

Preferably, the upright plate portion 98 includes an elongated slot 141 which may be circularly arcuate and concentric with the pivot axis for the discs, to permit slight rotational adjustments of the position of fixed arm 138 relative to the plate. Adjustments are facilitated by providing an adjustment screw 142 which is threaded through a boss 144 secured e.g. welded to the adjoining upright plate portion 98 so that the threaded end of the bolt engages the fixed arm 138. By loosening bolt 140 the rotational position of the fixed arm 138, and therewith of the associated fixed cutting disc 104 can be adjusted so as to precisely align cutting grooves 108 as is further described below. Once alignment has been achieved the bolt 140 is tightened to fix the short arm in that position.

A relatively long arm 146 projects radially from pivotable cutting disc 106 in a generally downward direction and has a free end defined by a convex head 148 which faces the free end 29 of slide 28 projecting from the guide way of rebar bending machine 2. A generally horizontal clamp 150 is pivotally attached to the lower end of long arm 146, for example with a bolt 152, and has an L-shaped free end 154 which is spaced from the movable arm 146 a distance so that the L-shaped end can drop into groove 36 defined by the opposing convexly arcuate bending surfaces 34 of spaced apart lugs 30 of the bending mechanism. Clamp 150 further includes an extension 156 which extends rearwardly, that is to the right as viewed in FIG. 8, and has a length and weight so that gravity tends to pivot the clamp in a counterclockwise direction as viewed in FIG. 8 into a position in which the L-shaped end 154 of the clamp drops into rebar bending groove 36 between lugs 30.

Figure 6:
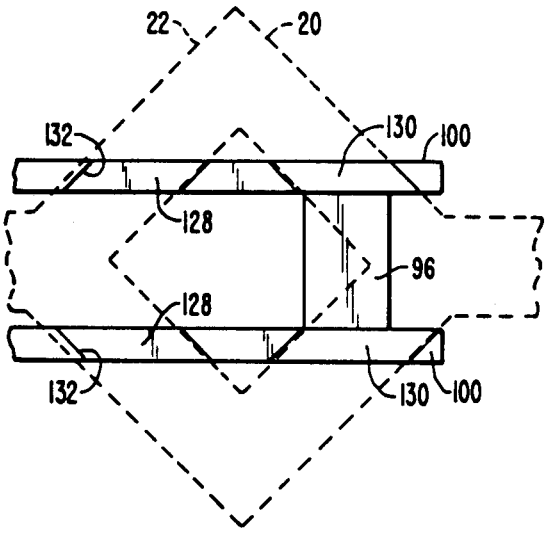
FIG. 6 is a fragmentary plan view and illustrates the manner in which the rebar bending machine is releasably attached to the rebar cutter in accordance with the present invention.
Figure 7:
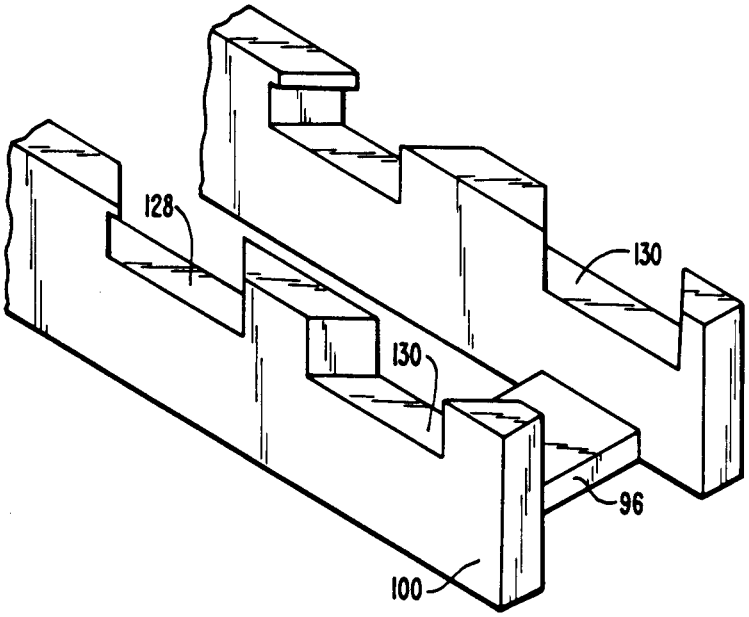
FIG. 7 is a fragmentary, side elevational view and illustrates in greater detail the construction of the portion of the rebar cutter for connecting it to the bending machine.

The horizontal portion 100 of L-shaped plate 94 is generally as described above except that the two angularly inclined slots illustrated in FIGS. 6 and 7 are replaced by a single cut-out 158. It is upwardly open and has a configuration so that the angularly inclined arms 20. 22 (not separately shown in FIG, 8) of the bending machine 2 can drop into the cut-out and the angular arms are in close proximity to the vertical end walls of the cut-out. This permits the connection of the bending machine 2 to the cutter by dropping the angular arms into the cut-out in the earlier described manner.

The embodiment shown in FIG. 8 is used by placing the yoke, i.e. the angular arms into the upwardly opened cut-outs 158 of the horizontal plate portion 100. The user now steps on clamp extension 156 and pushes it down to pivot it into its opened, inclined position (shown in phantom lines in FIG. 8), i.e. he thereby raises the L-shaped end to clear lugs 30 of the slide. He now operates handle 10 to move free end 29 of slide 28 into contact with convex head 148 of pivot arm 146. The foot is removed from clamp extension 156 so that it can pivot under its own weight into its essentially horizontal position at which point its L-shaped end 154 drops into groove 36 between the opposing lugs 30 of the bending mechanism. Handle 10 is now operated to rotationally move disc 106, either by pushing it in a counterclockwise direction which free slide end 29 or by pulling it in a clockwise direction through the engagement of the L-shaped clamp by one of the two lugs 30 of the bending mechanism until the rebar cutting grooves 108 of the discs are aligned. The rebar to be cut is placed into the slots and handle is operated to push the arm in a counterclockwise direction with slide 28. Once the rebar is severed the handle is moved in the opposite direction which returns the movable disc 106 into its home position (in which both cutting grooves 108 are aligned) by pulling pivot arm 146 with slide 28 via lug 30 L-shaped clamp end 154 and clamp 150.

Since the return of the movable cutting disc 106 to its home position is achieved by temporarily connecting the disc via clamp 150 with the bending mechanism, substantially greater return forces can be applied. This makes it possible to bias the two discs axially against each other with greater force (by correspondingly tightening bolt 136) then is normally feasible when the disc is returned to its home position with a spring for example which typically exerts only a limited force.

I claim:

1. Apparatus for cutting a metal bar for use in conjunction with and activation by a bar-bending machine having an elongated base for supporting the machine on the ground, a bar-bending mechanism at a first end of the base including a linearly reciprocable slide adapted to apply a bending force to the bar during the bending operation, guide means connected with the base for guiding the slide during its linear movements, and handle means pivotally attached to the base and operatively coupled to the slide for linearly moving the slide in the guiding means between first and second positions in response to corresponding pivotal movements of the handle means so that the slide protrudes from the guide means when it is in the second position, the apparatus comprising a generally L-shaped support frame defined by generally transverse, interconnected legs, a first leg including holding means for mechanically engaging the base of the bending machine adjacent the first end thereof to prevent relative movements between the bending machine and the frame at least in the direction of linear movements of the slide in the guide means, first and second bar cutting discs having opposing faces in substantial contact with each other and mounted to the frame for relative pivotal movement about an axis substantially perpendicular to the direction of movement of the slide in the guide means, each disc including an aperature and the aperatures and the discs being positioned so that they can be axially aligned means preventing pivotal movements of the first disc, and an actuating arm protruding from the second disc, the arm being arranged relative to the base of the bending machine so that an end of the slide protruding from the guide means engages the arm and moves it to thereby pivotally move the second disc relative to the first disc when the handle means is operated to move the slide towards the second position, whereby a bar placed in the disc aperatures while the aperatures are in mutual alignment is cut when the slide is moved from the first to the second position.

2. Apparatus according to claim 1, including means for biasing the arm into engagement with the slide.

3. Apparatus according to claim 1 wherein the aperatures in the discs are defined by peripherally open grooves in the discs.

4. Apparatus according to claim 1 wherein the arm protrudes generally radially from the second disc wherein the slide engages a radially outermost end portion of the arm, and including a roller carried by the arm at its outermost portion and positioned to be engaged by the slide to thereby reduce wear and friction.

5. Apparatus according to claim 1 wherein the holding means includes means for preventing relative movement between the base and the frame in directions transverse to the slide movement in the guide means.

6. Apparatus according to claim 5 wherein the transverse direction is generally parallel to the elongated base supported on the ground.

7. Apparatus according to claim 5 wherein the transverse direction is generally perpendicular to the elongated base support on the ground.

8. Apparatus according to claim 5 wherein the holding means is defined by upwardly open slots in the frame adapted to receive the base so that the cutter can be operatively connected with the bending machine by placing the cutter on the ground and dropping the first end of the base in a downward direction into the slots so that the first leg of the frame supports the first end of the base on the ground during use of the cutter.

9. Apparatus according to claim 1, wherein the actuating arm includes means located proximate a free end of the arm defining a concave surface positioned to be engaged by the end of the slide protruding from the guide means.

10. Apparatus according to claim 1 including clamp means movably attached to the actuating arm and adapted to engage a portion of the slide for operatively connecting the actuating arm with the slide and moving the actuating arm with the slide from a position in which the disc aperatures are axially offset relative to each other to a position in which the disc aperatures are axially aligned.

11. Apparatus according to claim 10, wherein the slide includes lug means defining a groove into which rebar is placed for bending with the bar bending machine, and wherein the clamp means includes a generally L-shaped end adapted and positioned to be moved into and out of the groove for operatively connecting and disconnecting the clamp means and therewith the actuating means from the slide.

12. Apparatus according to claim 11, including means for pivotally connecting the clamp means to the actuating arm, and wherein the clamp means includes an extension adapted so that a downwardly acting force applied to the extension pivotally moves the L-shaped end of the clamp means upwardly and out of engagement with the slide.

13. Apparatus according to claim 11, wherein the means preventing pivotal movements of the first disc comprises a locking arm attached to and protruding from the first disc and located proximate a leg of the support frame. the frame including an elongated aperature positioned so that the locking arm overlies the aperature, bolt means extending through the oblong aperature for fixedly securing the locking arm to the frame and thereby prevent pivotal movements of the first disc, and adjustment means operatively coupled with the locking arm and the frame for pivotally moving the locking arm in relatively small increments over at least a portion of the length of the oblong aperature while the bolt means is released.

14. Apparatus according to claim 13 wherein the adjustment means comprises a boss secured to the frame and a set screw threaded through the boss and having an end in engagement with an edge of the locking arm.

15. Apparatus for cutting bar adapted to be used in conjunction with and operated by a bar-bending machine. the bar-bending machine having an elongated base defining a linear guideway which is open at an end of the base, a slide reciprocally movably disposed in the guideway, and means for reciprocating the slide in the guideway so that in one terminal position of the slide an end thereof protrudes from the open guideway the apparatus comprising:

first and second, spaced apart, rigidly interconnected plates defining a generally horizontal portion and a generally upright portion;

first and second, axially aligned cutting discs carried on a shaft extending between the upright portions of the plates, the discs having an effective width substantially equal to a spacing between the plates, each disc further including a radially open groove positioned so that the grooves can be aligned and a bar to be cut can be placed therein:

means preventing pivotal movement of the second disc on the shaft:

an actuating arm projecting generally radially from the first disc in a downward direction towards the horizontal plate portions;

upper sides of the horizontal plate portions including upwardly open slots shaped so that the base can be positioned therein, the slots being sized so as to effectively prevent relative motions between the plates and the base when the base is disposed in the slots, the slots being further formed so that a radially outer portion of the actuating arm is in substantial alignment with and in proximity to the guideway at said end of the base when the grooves in the discs are in mutual alignment so that movement of the slide end out of the guideway engages the portion of the actuating arm and causes corresponding pivotal movement of the first disc relative to the second disc:

whereby a bar placed in the aligned disc grooves is cut when the base is disposed in the slots of the horizontal portion of the plates and the reciprocating means is operated to move the slide end out of the guideway to thereby move the disc slots relative to each other.

16. Apparatus according to claim 15, including spring means in operative engagement with the actuating arm and a plate for biasing the actuating arm towards the open guideway and therewith into engagement with the end of the slide projecting therefrom.

17. Apparatus according to claim 15 including means attached to the actuating arm for applying forces acting opposite directions to pivotally move the actuating arm. and therewith the first disc in opposite directions.

18. Apparatus according to claim 15 wherein the the base has a predetermined thickness and wherein the slots in the horizontal plate portions have a depth which is greater than the thickness of the base.

19. Apparatus according to claim 18, including an overhang defined by at least one plate and an end of the slot closest to the vertical plate portion, and extending over a vertical projection of the corresponding slot, the overhang being spaced from a bottom of the slot a distance slightly greater than the thickness of the base and extending over the corresponding slot a relatively short distance so as to permit the positioning of the base in the slot by moving the stabilizing means generally downwardly into the slot while it is inclined relative to the horizontal, whereby the overhang prevents relative vertical movements between the plates and the bases and thereby between the cutter and the bending machine, when the base is substantially fully disposed in the slots.

20. Apparatus for cutting and bending a metal bar comprising:

an elongated base having a transverse stabilizer attached to the base adjacent a first end thereof for preventing lateral tilting of the base when placed on the ground, the base defining a tubular, linear guideway having an open end at the first end of the base and an upwardly open, elongated slot communicating with the guideway:

an elongated slot linearly reciprocally disposed within the guideway and including an end adapted to project past the open guideway end the slide having lug means projecting through the slot and defining a first groove above the slot which is oriented substantially perpendicular to the guideway:

first and second forming posts mounted to the stabilizer proximate the first end of the base, the forming posts straddling the lug means and being located relative to the slot so that the lug means can be positioned on either side of the posts by correspondingly moving the slide in the guideway:

an operating handle pivotally mounted to the base disposed on a side of the forming posts opposite the first end of the base and being operatively connected with the slide so that pivotal movements of the handle are translated into linear movements of the slide, the slide being further movable between a first position at which the groove is on one side of the forming posts and a second position in which the groove is on another side of the forming posts, the end of the slide in one of the first and second positions projecting past the open guideway end;

rigidly interconnected, spaced apart plates and a pivot shaft extending between the plates, the plates being adapted to be positioned proximate the first end of the base;

first and second cutting discs carried on the shaft and including peripherally open grooves which are formed to be aligned:

means preventing pivotal movement of the first disc, the second disc including a generally radially projecting arm arranged to be substantially aligned with and proximate to the open guideway end when the disc grooves are in mutual alignment: and holding means preventing relative movement between the plates and the base in at least the direction of linear slide movements:

whereby pivotal movement of the handle to move the first groove between its first and second positions causes the formation of a bend in a bar placed in the first groove;

and whereby pivotal movement of the handle to move the slide between the first and second positions of the groove means causes a cutting of a bar placed into the aligned peripheral grooves of the cutting discs when the slide end engages the actuating arm and pivotally moves the actuating arm and the second cutting discs relative to the first disc.

21. Apparatus according to claim 20 wherein the holding means prevents relative movement between the plates of the base in substantially three, mutually perpendicular directions during pivotal movements of the handle and while the apparatus is disposed on the ground.

22. Apparatus according to claim 21 wherein the holding means releasably connects the plates to the stabilizer.

23. Apparatus according to claim 22 wherein the holding means is defined by upwardly open slots formed in the plates and adapted to engage the stabilizers.

24. Apparatus according to claim 20, including means biasing the actuating handle towards the open guideway end.

25. Apparatus according to claim 20, including second lug means projecting from the slide through the slot in the base and defining a second groove for accepting a metal bar for bending, a spacing between the first and second grooves being selected so that during linear slide movements between the first and second positions, the second groove moves from a first location, at which it is proximate the forming posts, to a second location on the same side of the forming posts and relatively remote therefrom whereby the bent bar can be straightened by placing it in the second groove so that portions of the bent bar engage the peripheries of the forming posts and moving the second groove from the second location to the first location thereof.

26. Apparatus according to claim 25 wherein the second lug means comprises a member attached to and projecting from the slide for movement therewith, the member defining a portion of the second groove and hook means movably attached to the member and including a section defining another portion of the second groove which is spaced from the first portion thereof so as to accommodate the bar to be bent in the second groove.

27. Apparatus according to claim 26 including means for pivotally movably securing the hook means to the member.

28. Apparatus according to claim 27 wherein the hook means is pivotable between first and second positions and is shaped so as to physically constrain the bar to be bent to the second groove when the hook means is in its first position and permit withdrawal of the bar to be bent from the second groove only when the hook means is in its second position.

29. Apparatus according to claim 28 including means for releasably locking the hook means in either its first or its second position.

30. Apparatus according to claim 29 wherein the locking means comprises a movable bolt and cooperating locking surfaces defined by the member and the bolt and arranged so that the bolt can be operated to move the locking surfaces into and out of operative engagement when the hook means is in either its first position or its second position to thereby correspondingly lock and unlock the hook means.

31. Apparatus according to claim 30 including means for biasing the bolt into the position in which the locking surfaces are in mutual engagement.

32. Apparatus according to claim 25 including means positioned on one side of the forming posts and pivotally mounting the handle to the base and wherein the discs means is positioned on the other side of the forming post from the means pivotally mounting the handle.

* * * * *